United States Patent [19]

Smith et al.

[11] 4,418,731

[45] Dec. 6, 1983

[54] ADAPTER FRAME FOR ROTO-TILLERS

[76] Inventors: Roger M. Smith, 205 Prospect St.; Steven J. Smith, R.R. 1, both of Shell Rock, Iowa 50670

[21] Appl. No.: 6,996

[22] Filed: Jan. 29, 1979

[51] Int. Cl.[3] ..... B27L 7/00

[52] U.S. Cl. ..... 144/194; 74/11; 144/366; 172/125; 172/247; 180/53 FE; 180/53 C

[58] Field of Search ..... 172/14, 42, 43, 125, 172/247, 292; 180/53 R, 53 WA, 53 C, 53 FE, 19, 198; 144/193 R, 194, 366; 74/13, 15, 15.6, 15.63

[56] References Cited

U.S. PATENT DOCUMENTS

| | | | |
|---|---|---|---|
| 1,487,962 | 3/1924 | Manville | 180/53 WA |
| 2,137,940 | 11/1938 | Goodman | 180/53 WA |
| 2,577,448 | 12/1951 | Carr | 180/53 C |
| 2,746,492 | 5/1956 | Hardit | 180/53 FE |
| 2,778,233 | 1/1957 | Perry . | |
| 3,670,789 | 6/1972 | Long | 144/194 |
| 3,993,113 | 11/1976 | Thackery | 144/194 |
| 4,026,337 | 5/1977 | Thackery | 144/193 R |
| 4,027,709 | 6/1977 | Thackery | 144/193 R |
| 4,132,255 | 1/1979 | Thackery | 180/53 WA |
| 4,335,762 | 6/1982 | Reaume et al. | 144/193 R |

OTHER PUBLICATIONS

"Most Machine for Your Money"; Rofo-Hoe & Sprayer Co.; The Roto Buzz Saw p. 13, 1954.

*Primary Examiner*—W. D. Bray

*Attorney, Agent, or Firm*—Zarley, McKee, Thomte, Voorhees & Sease

[57] ABSTRACT

A log splitter attachment for use with a garden tiller. The log splitter attachment is comprised of a frame portion which is releaseably attached to the roto-tiller drive shaft, a log splitting screw which is releaseably attached to the tiller drive shaft to allow for rotatable movement of said splitting screw in unison with the garden tiller drive shaft, and a log support bar attached to the frame portion and extending outwardly for ground engaging support to provide a log rest support during use, and to stabilize the frame portion and the tiller during use.

10 Claims, 4 Drawing Figures

ADAPTER FRAME FOR ROTO-TILLERS

BACKGROUND OF THE INVENTION

Mobile garden tillers, often referred to as "roto-tillers" are well known and have in the past few years come into general widespread use. Such roto-tillers are quite expensive and during the off season for gardening have little or no use for their owner. No doubt the seasonal usage of such tillers has prevented some prospective buyers from purchasing such units.

Applicants have discovered a useful frame attaching means for a roto-tiller which allows that tiller to be used year around. The primary purpose for applicant's roto-tiller attachment frame is to allow log splitting; however, as explained in the detailed description of the invention, the frame attachment of this invention also is versatile in that it has many other uses.

Accordingly, one object of this invention is to provide an adapter frame for roto tillers, to make said tillers useful on a year around basis.

Another object of this invention is to provide a roto-tiller adapter frame which allows said roto-tiller to be conveniently and quickly used for log splitting of firewood.

Yet another object of this invention is to provide an inexpensive, quick and easy frame attachment for a roto-tiller which allows log splitting and which at the same time stabilizes said roto-tiller during use.

An even further object of this invention is to provide an inexpensive roto-tiller frame attachment which is safe, efficient, comprised of a minimum of parts, and which when used in conjunction with a roto-tiller, is wholly portable along with said roto-tiller.

Yet another object of this invention is to provide a frame attachment which, with minor adaptations, can not only be used for log splitting, but also may be used for a two wheel transport dolly, a portable table, a power take-off drive attachment, and a snow plow, as well as a variety of other uses which will become apparent from the detailed description, including a transport device for split logs.

SUMMARY OF THE INVENTION

The invention relates to a log splitter attachment for use with a garden tiller. The basic attaching frame has means for mounting the frame to a garden tiller, and means for attaching a log splitting screw to the drive shaft of a roto tiller to allow rotatable movement of the log splitting screw in unison with the tiller drive shaft. The frame also has as an essential element a log support bar upon which logs for splitting may be rested. In addition, the log support bar functions to stabilize the unit to prevent overturning caused by torque during the log splitting operation.

DETAILED DESCRIPTION OF THE INVENTION

Figure 1:
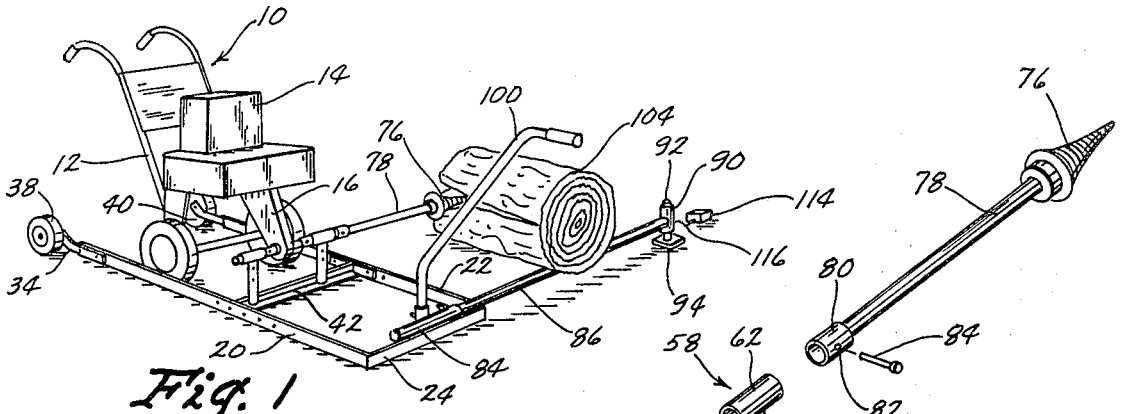
FIG. 1 is a perspective view of the log splitter attachment frame connected to a roto tiller during use in the log splitting operation.
Figure 2:
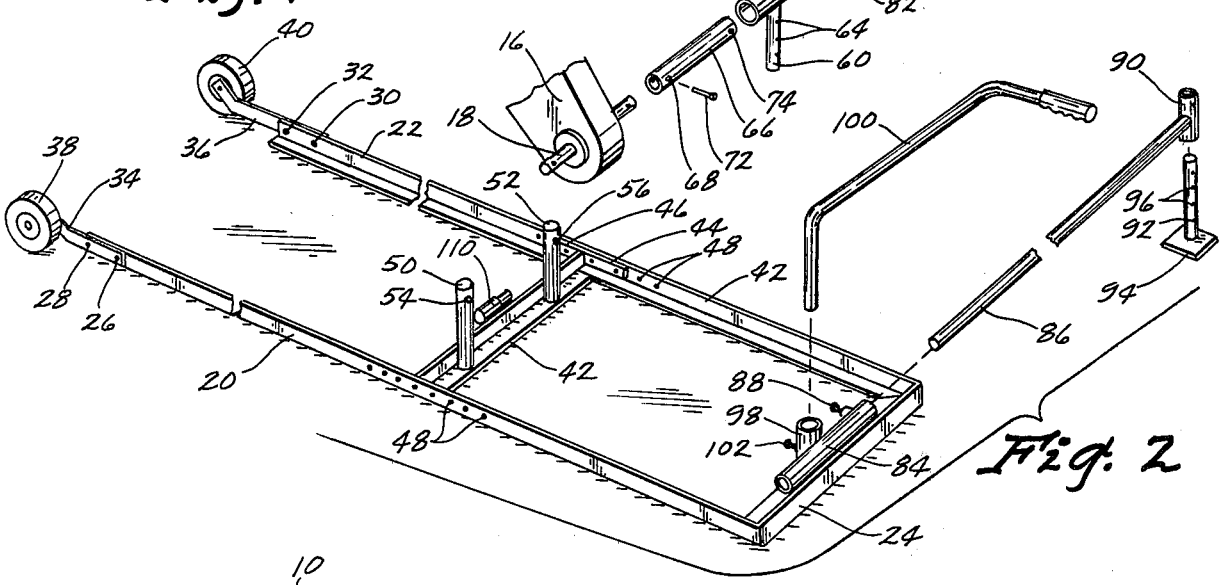
FIG. 2 is an exploded view of the frame showing its manner and means of attachment to the roto-tiller drive shaft.

Looking first at FIG. 1, a conventional roto-tiller 10 is comprised of a tiller frame 12, a roto-tiller power means 14, and a conventional transmission and power linkage depicted schematically at 16 and a rotatably driven roto-tiller drive shaft 18. Since the precise construction and manner of operation of a roto-tiller are well known, further details with respect to the roto-tiller per se, for sake of conciseness, will not be provided herein.

The basic frame for the log splitter is comprised of a pair of spaced apart parallel side members 20 and 22 joined together at one end by front frame member 24 which may be conveniently welded to the ends of side frame members 20 and 22. The rear end of frame members 20 and 22 is left open so that a roto-tiller 10 may be moved into the frame. Thus, the basic framework formed by side frame members 20 and 22, and front frame member 24 is U-shaped.

Figure 3:
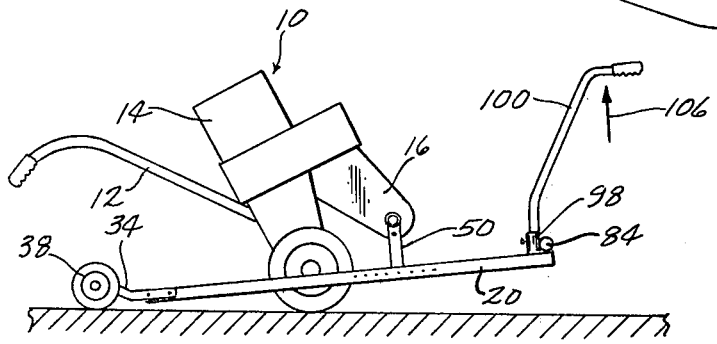
FIG. 3 is an elevated side view showing the log splitter attachment and garden tiller in a transport position.

At the open end of the U-shaped frame portion, each of sides 20 and 22 have a pair of spaced apart apertures 26, 28 and 30 and 32, respectively. Angular metal straps 34 and 36 may be attached via conventional bolts or the like to frame members 20 and 22, respectively. At the end opposite their attachment to frames 20 and 22, straps 34 and 36 carry transport wheels 38 and 40 attached by conventional means. As can be seen, straps 34 and 36 have at their midway portion, a generally upwardly inclined bend in order to allow the bottom surface of wheels 38 and 40 to rest on the same surface as the bottom of side frame members 20 and 22. As will be explained hereinafter, when the frame's forward portion is picked up for transport, wheels 38 and 40 will then rest on the ground for rolling movement as best depicted in FIG. 3.

Approximately midway between the forward end of side frame members 20 and 22, and the rearward end thereof is a cross bar 42 which joins side members 20, 22 at their midway section. As can be seen, crossbar 42 is joined at each end to a mounting plate 44 (only one is shown in the drawing). Mounting plate 44 has a plurality of bores 46 which may be aligned with bores 48 in side frame members 20 and 22 to allow for lateral adjustment of cross-bar 42 to provide different spacing, as needed for differing roto-tiller units. Of course, mounting plate 46 is attached via bores 46 to side frame members 20 and 22 by conventional bolt means placed between bores 46 in mating alignment with bores 48.

A pair of upwardly extending mounting tubes 50 and 52 are welded to the cross-bar 42 as depicted. Each of tubes 50 and 52 have pin receiving holes 54 and 56, respectively.

A pair of bushing holders 58 is comprised of a downwardly extending tube portion 60 with a bushing holder collar 62 welded across the top thereof. Tube portion 60 is of a proper diameter to telescopically fit within mounting tubes 50 and 52. The height of bushing holder collar 62 with respect to side frame members 20 and 22 may be adjusted by mating alignment of one of the plurality of openings 64 in tube portion 60 with pin holes 54 and 56 of mounting tubes 50 and 52 and insertion of a pin therethrough. It is to be understood that while only one bushing holder 58 is specifically shown in the drawing, an identical unit is also employed to matingly fit within the other tube holder 50.

A pair of drive shaft connecting bushings of identical construction (therefore only one is shown) 66 are inserted through bushing holder collars 62 and pinned to roto-tiller drive shaft 18 via pin aperture 68 which is matingly aligned with pin aperture 70 of roto-tiller drive shaft 18 with pin 72 inserted therethrough. It can therefore be seen that connector bushing 66 is free to rotate within bushing holder collar 62 in unison with drive shaft 18.

At its end opposite the connection with roto-tiller drive shaft 18, bushing 66 has a second connecting pin aperture 74.

The log splitting screw is comprised of a conical splitting screw 76, which has attached at its base by conventional means a screw shaft 78. At the end of screw shaft 78 opposite conical screw 76, is screw shaft insert collar 80 which is welded thereto. Collar 80 has pin aperture 82 which is pinned to connector bushing 66 after insertion of bushing 66 into shaft insert collar 80 via mating alignment of pin hole 74 and 82 and insertion of pin 84.

It can therefore be seen as drive shaft 18 of roto-tiller 10 is rotated, screw shaft 78 will rotate within bushing holder 68, and correspondingly conical splitting screw 76 will rotate.

Mounted on the inside portion of front frame member 24 is rest bar sleeve 84. Log rest bar 86 is inserted into rest bar sleeve 84 and is laterally adjustable since it is slidable therein. Set screw 88 is tightened to provide a rigid connection of log rest bar 86 within rest bar sleeve 84. As best seen in the drawings, while the inner end of log rest bar 86 is joined via set screw 88 to rest bar sleeve 84, the outer end of log rest bar 86 has perpendicular extending sleeve 90. Sleeve 90 telescopically fits over stem 92 which in turn is mounted on ground support pad 94. Apertures 96 are matingly aligned with aperture 98 of sleeve 90 and a pin inserted therethrough to provide a rigid connection between sleeve 90 and stem 92 and which in turn provides ground support to stabilize the unit.

Mounted in vertical relationship to rest bar sleeve 84 is handle sleeve 98 which receives transport handle 100. Transport handle 100 is locked into handle sleeve 98 by a set screw 102.

In actual operation, the unit works as follows: Transport handle 100 is lifted and the unit carried to the desired proximity to a pile of logs. The roto-tiller 10 is inserted through the rearward opening of the frame between wheels 38 and 40 and mounted as previously described. When the roto-tiller is operated, drive shaft 18 rotates which in turn rotates drive shaft connector bushing 66 which in turn through its connection to screw shaft 78 via shaft insert collar 80 and pin 84 rotates conical splitting screw 76. A log 104 is rested at one end on log rest bar 86 and is pushed gently against conical splitting screw 76. Rotating conical splitting screw 76 grabs into log 104 when the tip of the log splitting screw 76 is pushed against log 104. As conical splitting screw 76 digs into log 104, it splits the log and pulls the log onto the conical splitting screw. Log rest bar 86 aids the pulling action of splitting screw 76 by providing sliding friction between log 104 and the log rest bar 86. That is to say, the log is self-feeding into splitting screw 76 without exertion of pressure by the operator. This self-feeding action is enhanced by sliding friction provided by log rest support bar 86. Support bar 86 may be adjusted to provide a parallel relationship with the ground via a height adjustment means provided by pad 94 and stem 92 in conjunction with collar sleeve 90. In addition, another important function is provided by log rest bar 86. Because of the torque caused by the turning of roto-tiller drive shaft 18, there is a tendency to have the roto-tiller 10 and the rear portion of attachment frame flip upwardly. The log rest bar 86 counteracts this torque and prevents such from occurring.

As seen in FIG. 3, for transport of the unit, transport handle 100 is merely lifted upwardly as indicated by arrow 106 causing the weight to be carried by wheels 38 and 40 and the unit may be conveniently rolled to a new position.

Figure 4:
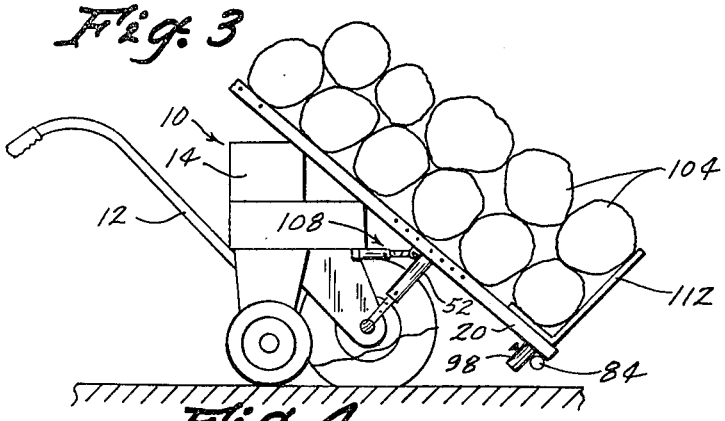
FIG. 4 shows in elevated side view how the basic log splitter frame may be attached for use as a transport dolly for logs.

The versatility of the unit is demonstrated in FIG. 4 which shows how the unit may be conveniently used as the transport dolly for split logs. The frame is simply inverted and attached to the roto-tiller shaft via mounting tubes 50 and 52 as previously described. A stabilizing connector bracket 108 is mounted from the roto-tiller 10 to the log splitting attachment frame work via sleeve 110 in conventional fashion. The purpose of this is merely to provide increased stabilization. A pair of right angle brackets 112 are detachably mounted to the bottoms of side frame members 20, 22 in conventional fashion as depicted in FIG. 4. Thus, as can be seen with transport handle 100 removed and log rest bar 86 removed, the roto-tiller may be simply moved in conventional fashion with the logs stacked thereon to provide a transport dolly.

With virtually minimal and in some cases no additional alteration, the unit may also be employed to transport a trailer, a snow plow, a portable table, a power take-off drive attachment for other means, a table support as well as many other uses.

For safety purposes, a foot operated shut off switch 114 may be employed with the switch electrically connected to roto-tiller 10 via wire 116, which runs through the inside of the log rest bar 86 and from there to roto-tiller 10.

In addition, the conical splitting groove 76 may, if desired, have at its rearward portion a plurality of spaced apart flared flanges to provide increased splitting action.

It can therefore be seen that the invention accomplishes at least all of its stated objectives.

What is claimed is:

1. A log splitter attachment for use with garden tillers having a tiller frame, a tiller power drive means and a tiller drive shaft, said splitter attachment comprising:

a ground supported frame portion, attachment means, mounted on said frame portion, for rotatably receiving said tiller drive shaft, thereby operatively connecting said garden tiller to said log splitter attachment, said attachment means being vertically adjustable to vary the operative height of said tiller drive shaft relative to the ground, a log splitting screw having means attached thereto for releasable attachment to said tiller drive shaft to allow for rotational movement of said splitting screw in unison with said tiller drive shaft and in generally axial alignment therewith, and a log support bar attached to said frame portion and extending outwardly therefrom for ground engaging support, to provide support for logs during use and to stabilize said frame portion and said tiller said attachment means being laterally adjustably mounted on said frame portion relative to the axes of said tiller drive shaft and log splitting screw whereby the distance between said log splitting screw and log support bar may be varied to accommodate logs of various lengths.

2. The device of claim 13 wherein means are provided to allow same frame portion, when inverted to be used in association with said tiller as a transport dolly.

3. The device of claim 1 wherein said log support bar is laterally adjustable.

4. The device of claim 3 wherein said log support bar includes vertically adjustable ground support pad at one end thereof.

5. The device of claim 1 wherein said frame portion has attached thereto a pair of spaced apart transport wheels, and a releasably attached transport handle.

6. The device of claim 1 which also includes a safety stop switch, remotely positioned from said tiller power drive means.

7. The device of claim 1 wherein the means for attaching said log splitting screw to said tiller drive shaft is a drive shaft connector bushing having means at one end for attachment to said tiller drive shaft and means at its other end for attachment to said log splitting screw.

8. The device of claim 7 wherein connecting bushing is attached via connecting means to said frame portion, and freely rotatable within said connecting means.

9. The device of claim 1 wherein said frame portion includes a pair of spaced-apart parallel side members, joined together at a front end by a front frame member, thereby to define a generally U-shaped frame portion.

10. The device of claim 11 wherein said frame portion further comprises a pair of transport wheels mounted on rear ends of said pair of side members, and a transport handle releasably attached to said front frame member.

* * * * *